US005090342A

United States Patent [19]

Conte

[11] Patent Number: 5,090,342

[45] Date of Patent: Feb. 25, 1992

[54] SEWING MACHINE WITH A SEWING HEAD INCLUDING A ROTARY HOUSING

[75] Inventor: Robert F. I. Conte, Detmold, Fed. Rep. of Germany

[73] Assignee: Durkopp Adler Aktiengesellschaft, Fed. Rep. of Germany

[21] Appl. No.: 628,606

[22] Filed: Dec. 17, 1990

[30] Foreign Application Priority Data

Dec. 28, 1989 [DE] Fed. Rep. of Germany ..... 3943131

[51] Int. Cl.[5] ..... D05B 21/00; D05B 69/00

[52] U.S. Cl. ..... 112/121.15; 112/221

[58] Field of Search ..... 112/117, 121.12, 121.15, 112/121.13, 166, 220, 221, 70, 71, 259, 121.14, 102

[56] References Cited

U.S. PATENT DOCUMENTS 4,541,348 9/1985 Fischer ..... 112/121.12
4,553,489 11/1985 Landwehr ..... 112/220 X
4,574,718 3/1986 Scholl et al. ..... 112/121.12
4,594,954 6/1986 Bernewasser ..... 112/121.15
4,787,324 11/1988 Fischer et al. ..... 112/121.12
4,787,326 11/1988 Scholl et al. ..... 112/262.3
4,817,543 4/1989 Fischer ..... 112/220 X
4,926,769 5/1990 Upmeier ..... 112/121.12

FOREIGN PATENT DOCUMENTS 2023186 11/1970 Fed. Rep. of Germany .

*Primary Examiner*—Werner H. Schroeder
*Assistant Examiner*—Paul C. Lewis
*Attorney, Agent, or Firm*—Laff, Whitesel, Conte & Saret

[57] ABSTRACT

A sewing machine has a sewing head with a rotary housing, in which a needle bar is arranged, which is slidably supported. A 1st partial transmission unit and a 2nd partial transmission unit are provided as a drive and have a total transmitting ratio of 1. In order to make the moment of inertia of the rotary housing as small as possible, the transmitting ratio of the 1st partial transmission unit is smaller than 1 and the transmitting ratio of the 2nd partial transmission unit is correspondingly larger than 1.

6 Claims, 6 Drawing Sheets

SEWING MACHINE WITH A SEWING HEAD INCLUDING A ROTARY HOUSING

FIELD OF THE INVENTION

The invention relates to a sewing machine with a sewing head and a device for the generation of a two-axes-relative movement of a workpiece to be sewn in relation to the sewing head, comprising a rotary housing rotatably supported at the sewing head, an axis, about which the rotary housing is rotatable, a needle bar carrying a needle and being slidably supported to generate a needle transport movement being drivably arranged essentially in the direction of the axis in the rotary housing, a needle bar drive drivable by way of a first and a second partial transmission unit, the first partial transmission unit having a first input end gear rotatably supported concentrically to the axis and a first output end gear directly coupled with the first input end gear by form locking and extending axially parallel to the first input end gear, the second partial transmission unit having a second input end gear and a second output end gear directly coupled with the second input end gear, the first input end gear of the first partial transmission unit and the second input end gear of the second partial transmission unit being arranged axially parallel to one another, and the total transmitting ratio of the first and the second partial transmission unit being 1.

BACKGROUND OF THE INVENTION

U.S. Pat. No. 4,787,326 describes such a sewing machine with the transmitting ratio of the two partial transmission units being in each case 1, i.e. the input end gears and the output end gears of each partial transmission unit have the same diameter or the same number of teeth. Due to the arrangement of the partial transmission units the constructional depth of the rotary housing relative to its axis of rotation is comparatively large. As a consequence the moment of inertia is comparatively large, which, in turn, leads to the fact that the acceleration of the rotary housing requires corresponding turning moments from the side of the drive.

In the case of the known sewing machine the drive of the needle bar is effected by means of a crank drive structured as a needle bar drive, with a thread feeder drive being in turn deducted from the crank pin or crank link of the needle bar drive. This, too, serves to increase the constructional depth of the rotary housing—relative to its axis of rotation—and thus the moment of inertia of the rotary housing.

Sewing machines with rotary housings and comparable in terms of kinematics are known from German patent 20 23 186, U.S. Pat. No. 4,574,718, U.S. Pat. No. 4,553,489 and U.S. Pat. No. 4,594,954.

SUMMARY OF THE INVENTION

It is the object of the invention to develop an improved sewing machine of the generic kind, such that the moment of inertia of the rotary housing is reduced.

According to the invention this object is achieved by the 1st input end gear of the 1st partial transmission unit having a diameter larger than a diameter of the 1st output end gear, and by the 2nd input end gear of the 2nd partial transmission unit having a diameter smaller than a diameter of the 2nd output end gear. By the transmitting ratio of the 1st partial transmission unit becoming less than 1 and the transmitting ratio of the 2nd partial transmission unit becoming more than 1 in such a way that the total transmitting ratio of both partial transmission units remains 1, it is achieved that the output end gear of the 1st partial transmission unit and the input end gear of the 2nd partial transmission unit come closer to the axis of rotation of the rotary housing, whereby in turn the total radial constructional depth of the rotary housing is reduced in relation to its axis of rotation. When $0.5<i1<0.8$ applies for a transmitting ratio of the 1st partial transmission unit, which is defined as $i1=d51/d49$ by the quotient of the diameter of the 1st output end gear and of the diameter of the 1st input end gear, this indicates a practicable range of the transmitting ratio of the 1st partial transmission unit, from which the transmitting ratio of the 2nd partial transmission ratio directly results. This range of the transmitting ratio leads to an especially good space saving.

As a result of the refinement according to which the 2nd partial transmission unit is coupled with a thread feeder drive, and the needle bar drive is arranged on a first side of the needle bar and the thread feeder drive is arranged on a second side of the needle bar, which second side is opposite the first side, and according to which the needle bar drive and the thread feeder drive are indenpendently of each other coupled with the 2nd partial transmission unit, the needle bar drive is shortened in structure, since the thread feeder drive is not deducted from the needle bar drive as otherwise usual. Rather, both drives are placed on different sides of the needle bar, thus rendering the total structure of the rotary housing even more compact, i.e. its moment of inertia is further reduced. Advantageous embodiments of this consist in that the needle bar drive has a shaft drivable by the 2nd partial transmission unit, in that the thread feeder drive has a shaft drivable by the 2nd partial transmission unit, in that these shafts are arranged parallel to one another, and in that the shafts of the 2nd partial transmission unit are drivable by an auxiliary shaft parallel to the shafts and each by a drive connecting the auxiliary shaft with a shaft and being located each on one of the first and the second side of the rotary housing. The embodiment, according to which—in relation to the axis of the rotary housing—each of the shafts is arranged on one of two different sides of the auxiliary shaft, serves to reduce the constructional height of the rotary housing.

Further details, advantages and features of the invention will become apparent from the ensuing description of two examples of embodiment taken in conjunction with the drawings.

DESCRIPTION OF THE PREFERRED EMBODIMENTS

Figure 1:
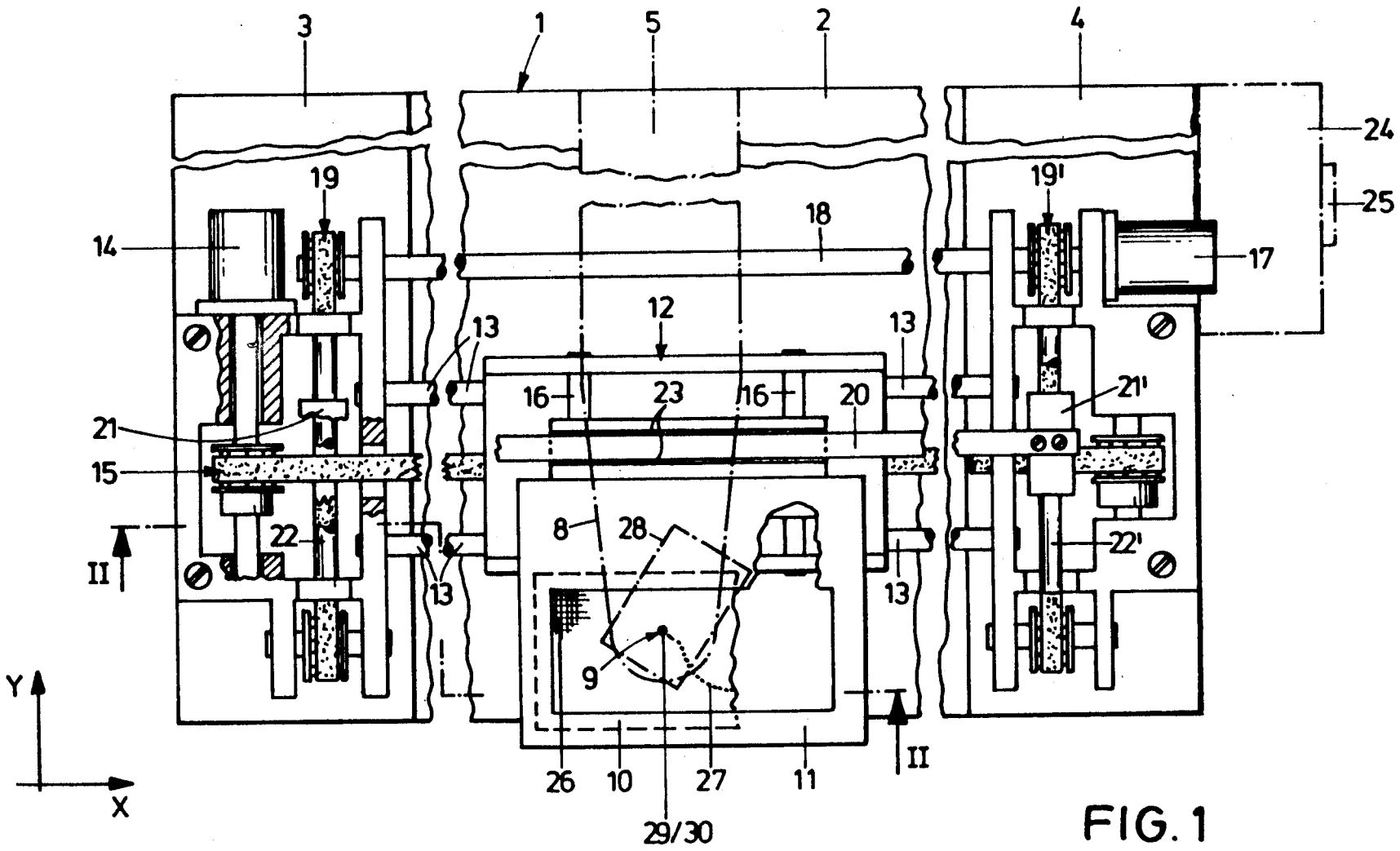
FIG. 1 is a top view of an automatic sewing machine with a device for the generation of a two-axes-relative movement of a workpiece in relation to a sewing head.
Figure 2:
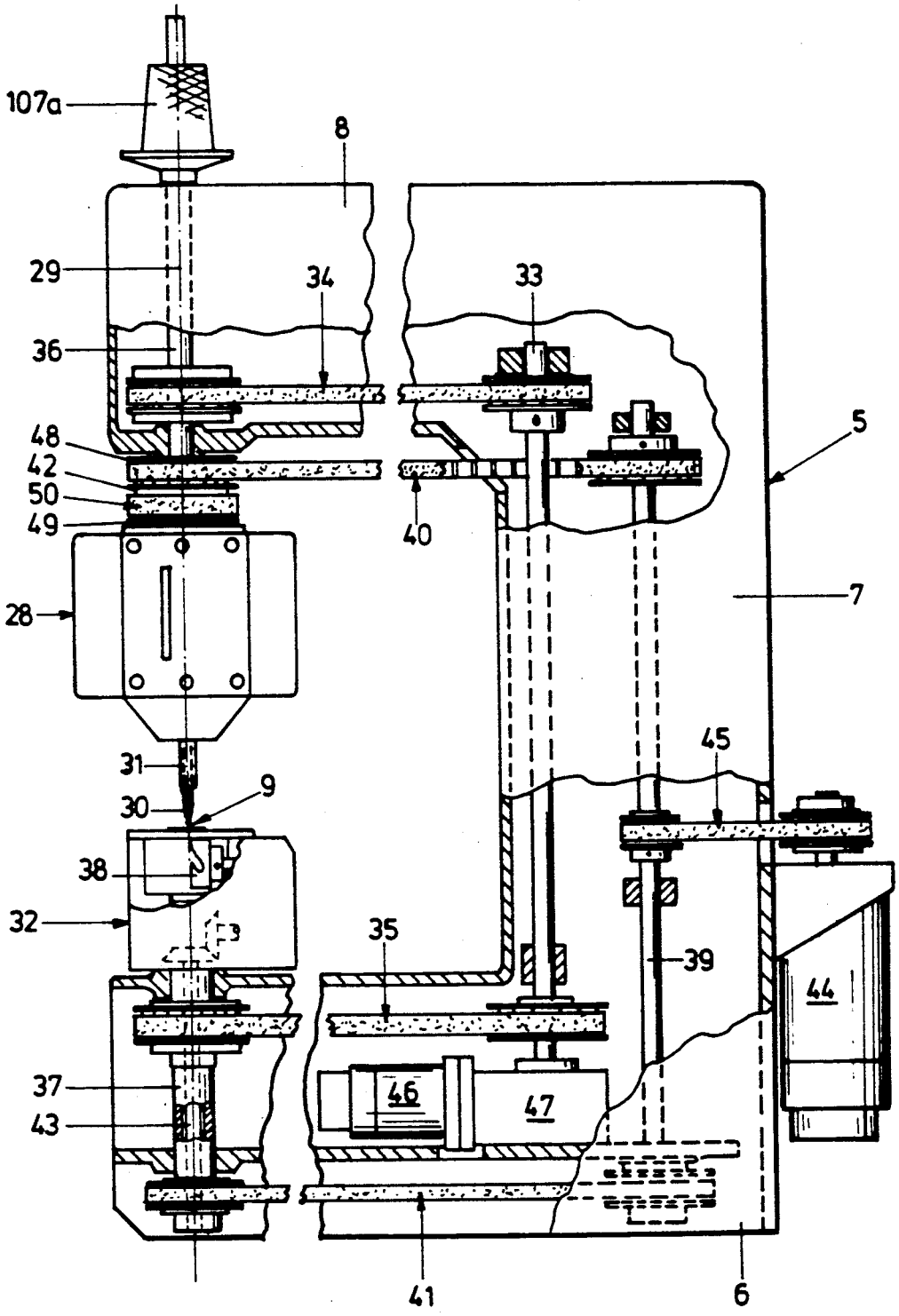
FIG. 2 is a longitudinal view of the sewing head of the sewing machine in a substantially broken up representation.

The automatic sewing machine shown in the drawing has a stand 1 comprising an intermediate section 2 and two lateral sections 3 and 4. A sewing head 5 is arranged on the intermediate section 2 of the stand 1 and its base plate 6 is secured to the intermediate section 2. The sewing head 5 has a standard 7, which extends upwards from the base plate 6 and from which an upper arm 8 projects above the base plate 6 and parallel to it. In the area of the free ends of the base plate 6 and the arm 8 stitch forming instruments 9 are arranged. A workpiece holder 10 is provided between the base plate 6 and the arm 8, namely in the vicinity of the stitch forming instruments 9. This workpiece holder 10 is movable in two directions of coordinates, i.e. in y-direction approximately corresponding to the main direction of the sewing head 5, and in x-direction extending perpendicularly thereto. To this effect the workpiece holder 10 is arranged on an x-y-carriage system. This system has a y-carriage 11, which directly carries the workpiece holder 10 and which is supported and guided on an x-carriage 12 and is displaceable in y-direction relative to the x-carriage 12. In turn, the x-carriage 12 is displaceable in x-direction relative to the stand 1. Thus, the y-carriage 11 and with it the workpiece holder 10 are displaceable in x- and y-direction relative to the stand 1.

The x-carriage 12 is displaceably arranged on two guide rods 13 stationarily mounted to the stand 1 and extending parallel to each other.

A drive motor 14 driving the x-carriage 12 by way of a timing belt drive 15 is provided on the lateral section 3 shown on the left in FIG. 1.

Guide rods 16, on which the y-carriage 11 is arranged displaceably in y-direction, are in turn arranged on the x-carriage 12. The drive of the y-carriage 11 is effected by way of a drive motor 17 driving a shaft 18 supported on the two lateral sections 3 and 4 of the stand 1. Two timing belt drives 19, 19' are driven by this shaft 18. These timing belt drives 19, 19' are connected with a guide bar 20, which extends in x-direction and which, by means of slide bearings 21, 21', is in turn guided displaceably on guide rods 22, 22' extending in x-direction and arranged on the lateral sections 3, 4 of the stand 1. The guide bar 20 engages with an adapted guide groove 23 in the y-carriage 11. The drive of the guide bar 20 in y-direction ensures a drive free of canting of the y-carriage 11 in y-direction. Movements of the y-carriage 11 in x-direction together with the x-carriage 12 are easily possible, since the guide bar 20 extends absolutely parallel to the guide rods 13, i.e. in x-direction.

The drive motors 14, 17 may be stepping motors or d.c. motors with position feedback effecting a very precise program-controlled drive of the x-carriage 12, of the y-carriage 11 and thus of the workpiece holder 10 in x-y-direction. A control unit 24 with a receptable for a data carrier 25 is provided for the program-controlled drive. A workpiece 26, in which a seam is produced by means of the stitch forming instruments 9, is held in the workpiece holder 10.

A rotary housing 28 is supported rotatably about an axis 29 at the lower side of the free end of the arm 8. A needle 30 and a needle bar 31 carrying the needle 30 are provided in alignment with this axis 29. A hook bearing 32 pivotable with the rotary housing 28 about the same angle of rotation is supported on the base plate 6 structured as a housing below the rotary housing 28 and equally in alignment with the axis 29. The pivoting drive of the rotary housing 28 and of the hook bearing 32 is effected by an adjusting shaft 33 supported in the standard 7 parallel to the axis 29 via timing belt drives 34, 35. The timing belt drive 34 located in the arm 8 drives the rotary housing 28 via a shaft 36 concentric with the axis 29. The lower timing belt drive 35 located in the base plate 6 drives the hook bearing 32 via a hollow shaft 37. Since both timing belt drives 34, 35 have an identical transmitting ratio, the rotary housing 28 and the hook bearing 32 are rotatingly driven with the same angle of rotation.

The drive of the needle bar 31 with the needle 30, on the one hand, and of the hook located in the hook bearing 32 is effected by means of a mutual main drive shaft 39 via timing belt drives 40, 41. The upper timing belt drive 40 associated with the arm 8 ends in a double timing belt pulley 42 connected with the shaft 36 concentrically to the axis 29. The lower timing belt drive 41 located in the base plate 6 drives a hook drive shaft 43 located in the hollow shaft 37.

The main drive shaft 39 is driven by a main drive motor 44 mounted to the standard 7 via a timing belt drive 45. The drive of the adjusting shaft 33 is effected by a servo motor 46 arranged in the plate 6 structured as a housing and by a gear 47 downstream of the servo motor 46.

As far as the sewing machine is described in the foregoing, it is for example known from U.S. Pat. No. 4,787,326, which is explicitly emphasized so as to avoid any repetitions.

Figure 4:
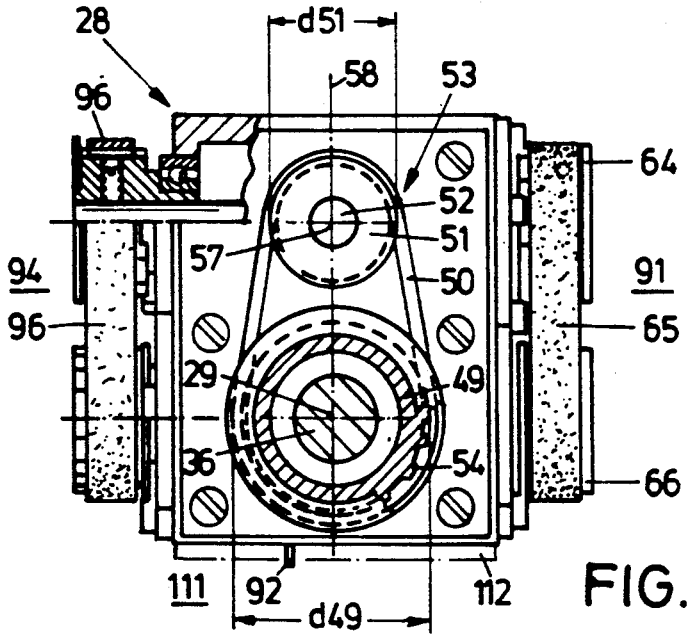
FIG. 4 is a top view of the rotary housing corresponding to the section line IV—IV in FIG. 3.

In addition to the timing belt pulley 48 associated with the timing belt drive 40 the double timing belt pulley 42 has an input end gear 49 structured as a timing belt pulley and non-rotatingly connected with the timing belt pulley 48. Via a timing belt 50 this input end gear 49 serves to drive an output end gear 51, which is located on the rotary housing, which is equally designed as a timing belt pulley, and which is non-rotatingly connected with a shaft 52 supported in the rotary housing 28 and extending parallel to the axis 29. The input end gear 49, the timing belt 50 and the output end gear 51 form a 1st partial transmission unit 53. The transmitting ratio i1 of this 1st partial transmission unit 53 is less than 1 corresponding to the diameters d49 of the input end gear 49 and d51 of the output end gear 51, since the diameter d51 of the timing belt pulley 51 is clearly smaller than the diameter d49 of the input end gear 49. Therefore, $i1=d51/d49<1$ applies for this transmission unit 53 is formed by a timing belt drive, this also corresponds to the ratio of the number of teeth 54 of the timing belt pulleys concerned shown in FIG. 4 only for the input end gear 49. Regarding the ratio of the number z51 of the teeth 54 of the output end gear 51 and the number z49 of the teeth 54 of the input end gear 49 $i1=z51/z49<1$ applies in the same manner.

Figure 5:
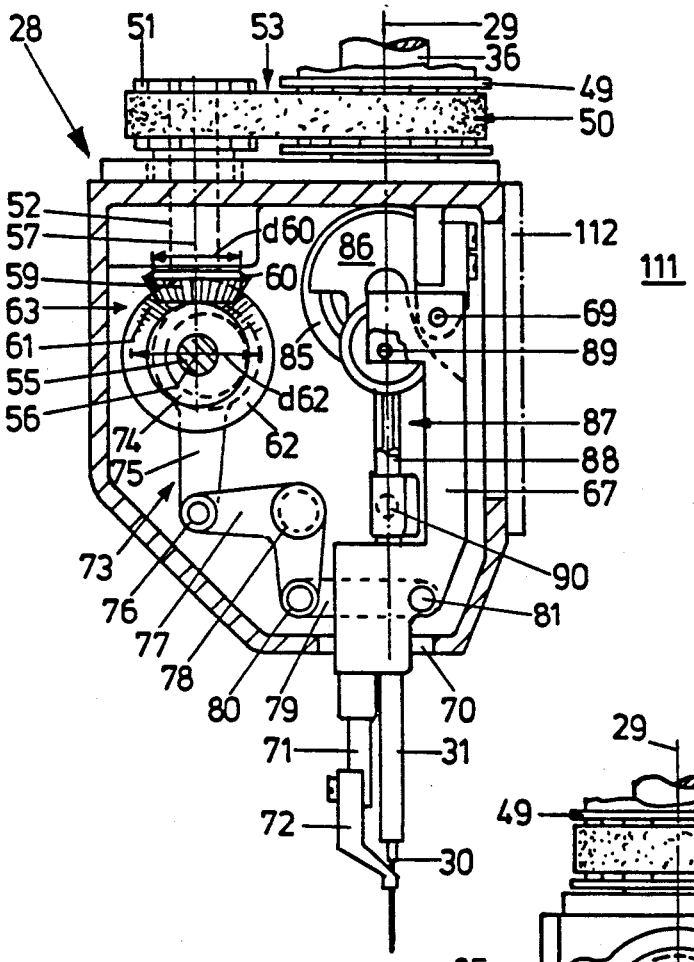
FIG. 5 is a vertical cross-section through the rotary housing corresponding to the section line V—V in FIG. 3.
Figure 6:
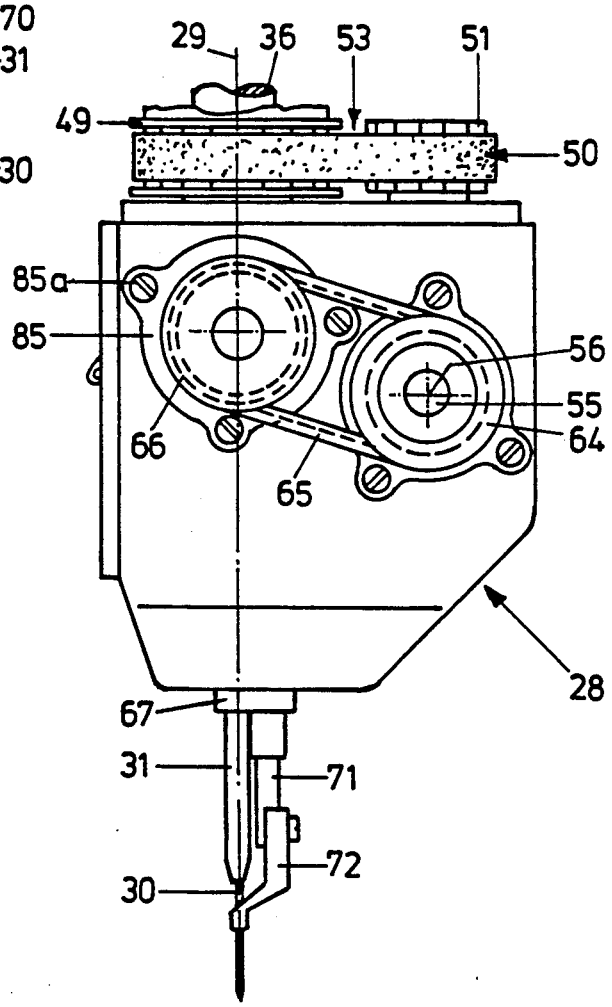
FIG. 6 is a side view of the rotary housing corresponding to arrow VI in FIG. 3.

An auxiliary shaft 55 is rotatingly supported in the rotary housing 28 and its axis 56 extends at a right angle to the plane 58 spread out by the axis 29 and the axis 57 of the shaft 52 and intersects the axis 57 of the shaft 52. A further input end gear 60 provided with teeth 59 and structured as a bevel gear is non-rotatingly mounted to the shaft 52 and engages with a further output end gear 62 non-rotatingly connected with the auxiliary shaft 55, and equally provided with teeth 61 and equally structured as a bevel gear. The input end gear 60 and the output end gear 62 form a 2nd partial transmission unit 63. As can in particular be taken from FIG. 5, the diameter d60 of the input end gear 60 is clearly smaller than the diameter d62 of the output end gear 62. The same is true for the ratio of the number z60 of the teeth 59 of the input end gear 60 with regard to the number z62 of the teeth 61 of the output end gear 62. $i2=d62/d60=z62/z60>1$ applies for the transmitting ratio i2 of the 2nd partial transmission unit 63. $i1\times i2=1$ duly applies for the total transmitting ratio. The auxiliary shaft 55 thus is driven at the same angle of rotation as the input end gear 49. If, for example, $i1=z51/z49=22/33=\frac{2}{3}$, then vice versa $i2=1.5$ must be true for i2, which is the case when $i2=z62/z60=33/22$. Due to this structure the axes 57 and 29 can be brought relatively close one towards the other, i.e. the constructional depth of the rotary housing in the direction of the plane 58 can be rendered particularly small. As for the transmitting ratios $0.5<i1<0.8$ and correspondingly $2>i2>1.25$ should apply.

The auxiliary shaft 55 drives a timing belt pulley 64 non-rotatingly connected with it, which serves to drive a timing belt of needle bar drive 66 via a timing belt. The transmitting ratio of the timing belt pulleys 64, 66 is 1.

The needle bar 31 is longitudinally slidably supported in a rocking frame 67, which can be rocked about a rocking bearing 68 located in the upper area of the rotary housing 28 about an axis 69 which extends at a right angle to the plane 58. The rocking frame 67 and thus the needle bar 31 can thus be rocked about the axis 69 in the plane 58 or parallel to it, to which effect a correspondingly sized recess 70 is provided at the lower side of the rotary housing. In conventional manner a presser foot bar 71 with a presser foot 72 is arranged on the rocking frame 67, the actuation of this bar 71 not being shown.

The rocking frame 67 is made to rock by means of a jogging drive 73. The latter has an eccentric cam 74, which is arranged on the bar 55 and which is connected with an angle lever 77 via a tie rod 75 by means of a link 76. This angle lever 77 is supported in the rotary housing 28 by means of a stationary bearing 78. In turn a tie rod 79 is articulated on the other end of the angle lever 77 by means of a link 80, which tie rod 79 is articulated on the rocking frame 67 by means of a link 81. Upon each full rotation of the auxiliary shaft 55 the rocking frame 67 is rocked back and forth once.

The timing belt of needle bar drive 66 is non-rotatingly arranged on a shaft 82, which is rotatingly supported in a flange bearing housing 85 by means of a needle bearing 83 and of a grooved ball bearing 84. The flange bearing housing 85 is secured in the rotary housing 28 by means of screws 85*a*.

At the end of the shaft 82 located in the rotary housing 28 a crank 86 of a needle bar drive 87 is non-rotatingly secured to the shaft 82, and a crank rod 88 is articulated on the crank 86 by means of a crank link 89. The other end of the crank rod 88 is articulated on the needle bar 31 by means of a needle bar link 90. Upon each rotation of the auxiliary shaft 55 and thus upon each rotation of the shaft 82 the needle bar 31 consequently carries out an up and down movement.

Figure 3:
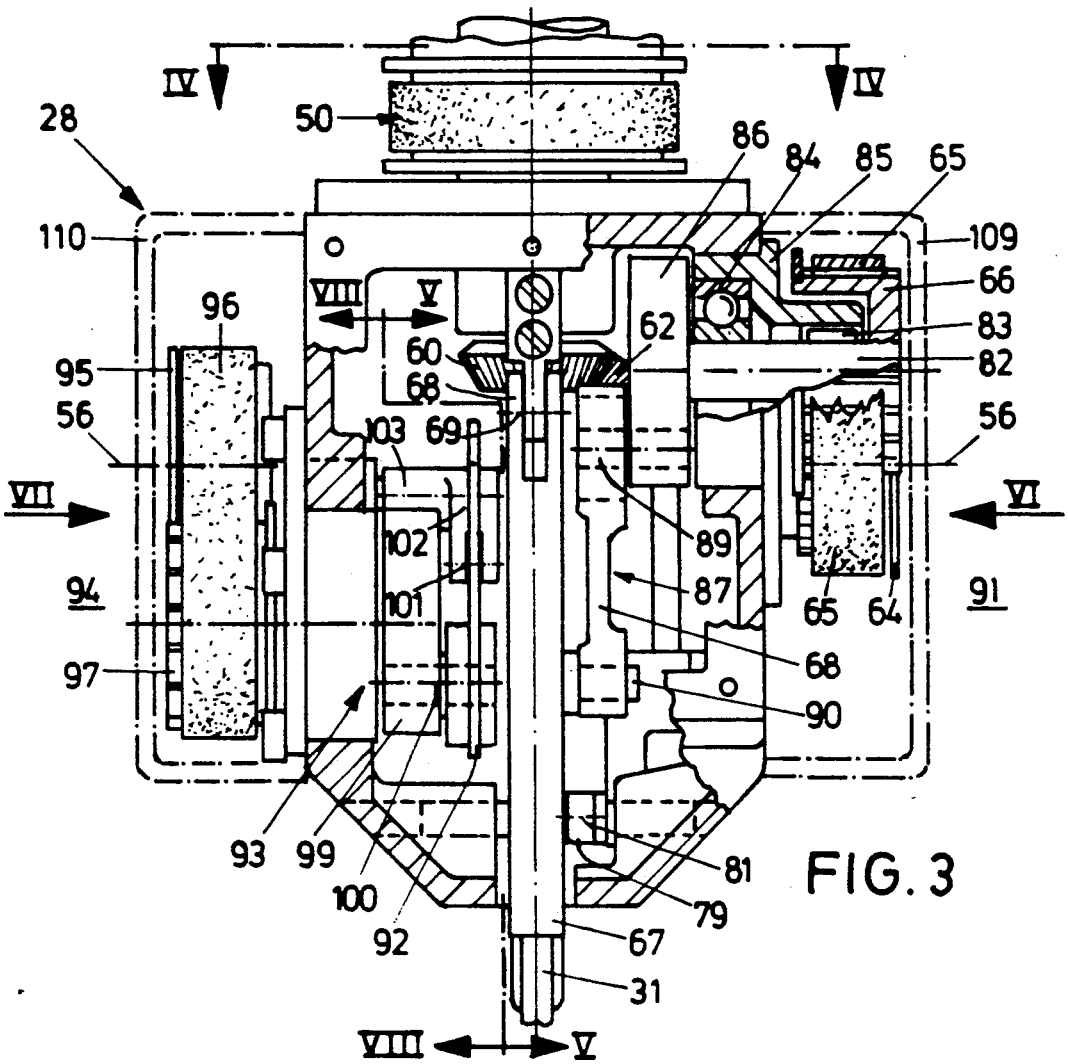
FIG. 3 is a cross-section through a rotary housing of the sewing head.

As can in particular be taken from FIG. 3, the rocking frame 67 is arranged approximately in the plane 58. The jogging drive 73 for the rocking frame 67 and the needle bar drive 87 for the needle bar 31 are on one side of the rocking frame 67 and thus also on one side 91 of the rotary housing 28. A thread feeder 92 including a thread feeder drive 93 are on the other side of the rocking frame 67 and thus on the opposite side 94 of the rotary housing 28.

On the side 94 a timing belt pulley 95 is non-rotatingly arranged on the auxiliary shaft 55 and drives a timing belt pulley 97 equally arranged rotatingly in the rotary housing by means of a timing belt 96 in a ratio 1:1. This timing belt pulley 97 is non-rotatingly secured to a shaft 98, which is supported in the rotary housing 28 and to which a crank 99 is mounted in turn. The thread feeder 92 structured as a thread lever is articulated on a crank pin 100 of this crank 99. About in its middle this thread feeder 92 is articulated on a thread feeder lever 102 by means of a link 101, the thread feeder lever 102 being in turn stationarily supported in the rotary housing 28 by means of a bearing 103. This bearing 103 is arranged in a flange bearing housing 104 for the shaft 98, which flange bearing housing 104 is in turn secured in the rotary housing 28 by means of screws 104*a*. As a result, the thread feeder drive 93 with the thread feeder 92 can be mounted or dismounted as an independent constructional unit together with the flange bearing housing 104. The above-described arrangement of the crank 99, of the thread feeder 92, of the thread feeder lever 102 and of the flange bearing housing 104 forms a four-linkage. With its free end 105, in which a needle thread bore 106 for a needle thread 107 is provided, the thread feeder 92 projects outwards through a recess 108 of the rotary housing 28. Upon a rotation of the auxiliary shaft 55 the thread feeder 92 performs an up and down rocking movement feeding a needle thread 107 to the needle 30. The thread feeder 92 rocks in a plane parallel to the plane 58. The needle thread 107 is drawn off a needle thread reel 107*a* arranged on the arm 8.

Figure 7:
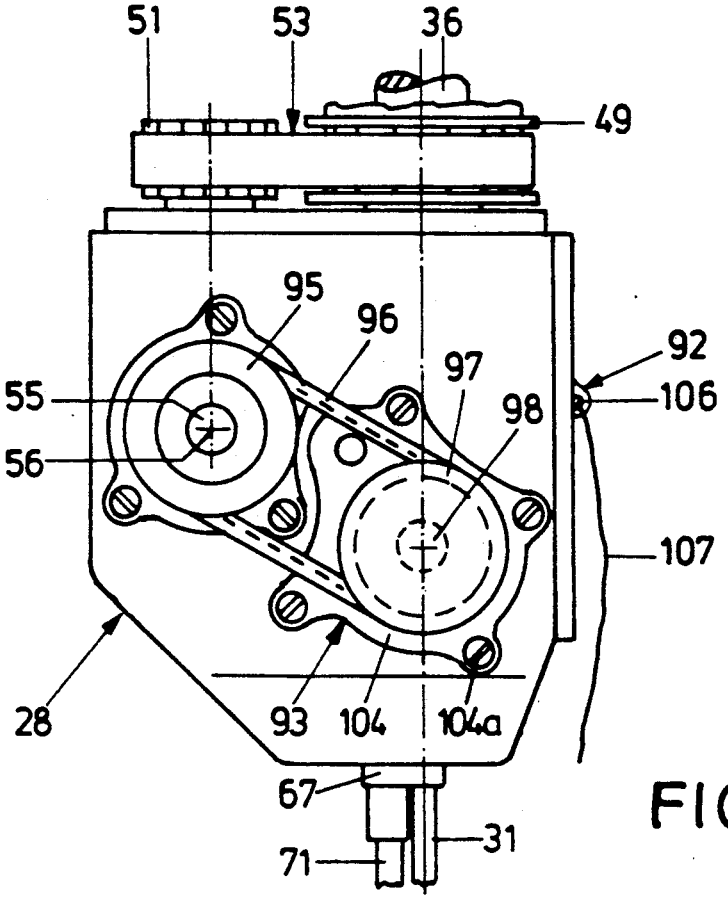
FIG. 7 is a side view on the rotary housing corresponding to arrow VII in FIG. 3.
Figure 8:
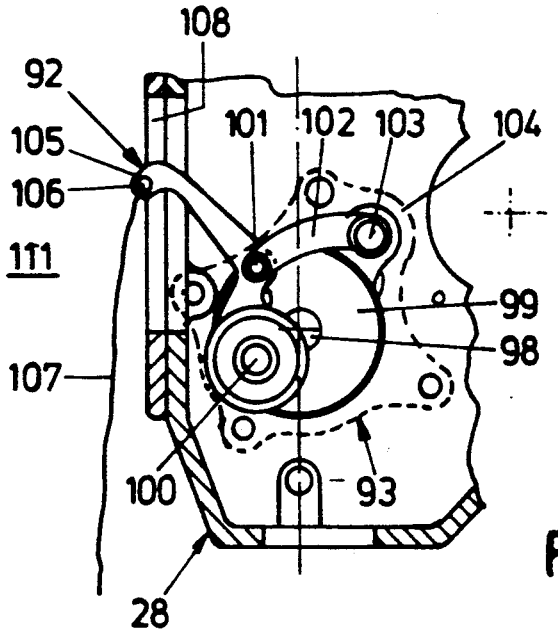
FIG. 8 is a partial section through the rotary housing according to section line VIII—VIII in FIG. 3.

As can be taken from FIG. 7, the thread feeder 92 and with it the thread feeder drive 93 is arranged below the auxiliary shaft 55. Thus the constructional height of the rotary housing 28 is reduced. As compared with this, the shaft 82 is arranged above the auxiliary shaft 55, whereby the needle bar drive 87 on the one hand and the jogging drive 73 on the other hand come comparatively far to the top in the rotary housing 28. This serves the same purpose.

On both of its sides 91, 94 the rotary housing 28 is provided with removable covers 109 and 110, which are indicated in dash-dotted lines only in FIG. 3 and which cover in particular the timing belt drives 64, 65, 66, on the one hand,and 95, 96, 97, on the other hand. A removable cover 112 is equally provided on the front side 111 of the rotary housing 28 having the recess 108 for the thread feeder 92 and being situated between the sides 91, 94.

Figure 9:
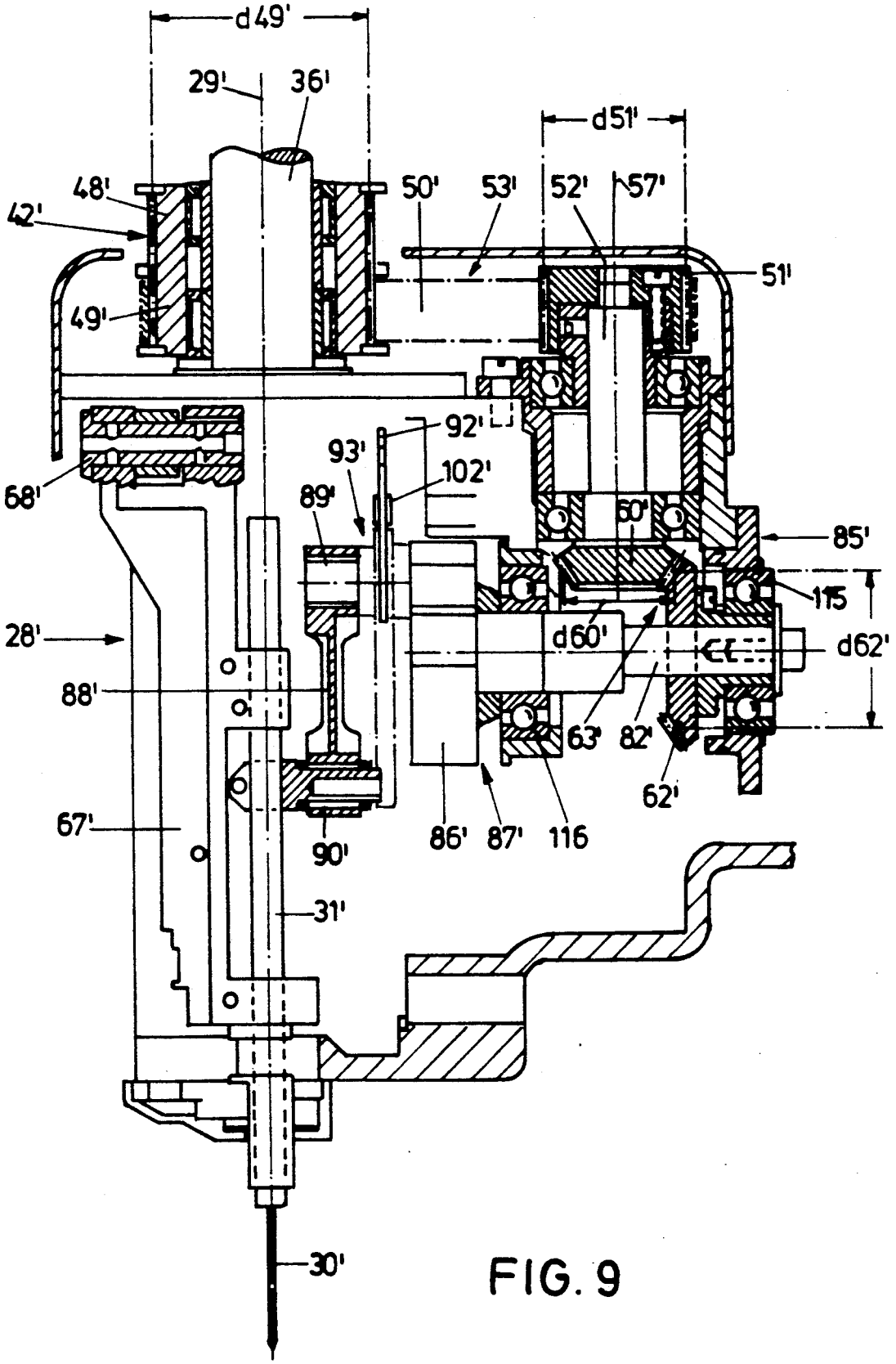
FIG. 9 is a longitudinal section of a modified embodiment of a rotary housing.

In many details the embodiment according to FIG. 9 is at least very similar to the embodiment according to FIGS. 3 to 8. As far as there are any parts equal in function and at least similar in construction the same reference numerals are used provided with a prime without being described once again in detail.

At the upper side of the rotary housing 28' a double timing belt pulley 42' is rotatably supported on a shaft 36' and comprises a timing belt pulley 48' and an input end gear 49' equally structured as a timing belt pulley. An output end gear 51' structured by a timing belt pulley is driven by a timing belt 50' and is non-rotatingly secured on a vertical shaft 52', of which the axis 57' extends parallel to the axis 29' of the shaft 36'. Here, too, the input end gear 49', the timing belt 50', and the output end gear 51' form a 1st partial transmission unit 53', of which the transmitting ratio i'1 is less than 1. $i'1=d51'/d!'<1$ applies for the ratio of the diameters d49' and d51'. The same is true for the ratio of the number of the not-shown teeth of these timing belt pulleys 49' and 51'.

The lower end of this shaft 52' bears a further input end gear 60', which is designed as a bevel gear and which engages with a further output end gear 62', which is designed as a bevel gear and which is in turn non-rotatingly arranged on a shaft 82' of a needle bar drive 87'. The input end gear 60' and the output end gear 62' form a 2nd partial transmission unit 63', of which the transmitting ratio i'2 is more than 1. $i'2=d62'/d60'>1$ applies for the diameters d60' and d62'. The same is true for the ratio of the number of not-shown teeth of these bevel gears 60', 62'. Here, too, the prerequisite applies that $i'\times i'2=1$. The shaft 82' is supported via a rolling-contact bearing 115 in a flange bearing housing 85' detachably mounted to the rotary housing 28', on the one hand, and, on the other hand, via a further rolling-contact bearing 116 in the rotary housing 28'. At its end facing away from the output end gear 62' it is provided with a crank 86', on which, via a crank link 89', a crank rod 88' is articulated, the other end of which is in turn mounted to a needle bar 31' via a needle bar link 90', which needle bar 31' carries a needle 30' at its lower end. The needle bar 31' is vertically slidably supported and guided in a rocking frame 67'. This rocking frame 67' is in turn supported to rock via an upper rocking bearing 68' in the rotary housing 28', namely on a plane perpendicular to the drawing plane of FIG. 9.

Between the crank rod 88' and the crank 86' a thread feeder drive 93' is arranged on the crank link 89' structured as a crank pin. In this case the crank link 89' also has the same function as the crank pin 100 in FIG. 8. The thread feeder 92' and the thread feeder lever 102' are only slightly indicated in FIG. 9.

What is claimed is:

1. A sewing machine with a sewing head (5) and a device for the generation of a two-axes-relative movement of a workpiece (26) to be sewn in relation to the sewing head (5), comprising:

a rotary housing (28, 28') rotatably supported at the sewing head (5) about an axis (29, 29');

a first partial transmission unit (53, 53');

a second partial transmission unit (63, 63');

a needle bar drive (87, 87') drivable by way of said first and said second partial transmission unit (53, 63; 53', 63');

a needle bar (31, 31') carrying a needle (30, 30') and being slidably supported in said rotary housing (28, 28') and being in driving connection to said needle bar drive (87, 87') essentially in the direction of the axis (29, 29') to generate a needle transport movement;

said first partial transmission unit (53, 53') having a first input end gear (49, 49') rotatably supported concentrically to said axis (29, 29') and a first output end gear (51, 51') directly coupled with said first input end gear (49, 49') extending axially parallel to said first input end gear (49, 49');

said second partial transmission unit (63, 63') having a second input end gear (60, 60') and a second output end gear (62, 62') directly coupled with said second input end gear (60, 60');

means (52) connecting said first output end gear (51, 51') to said second input end gear (60, 60') and said first input end gear (49, 49') of the first partial transmission unit (53, 53') and second input end gear (60, 60') of said second partial transmission unit (63, 63') being provided axially parallel to one another;

and a total transmitting ratio of said first and second partial transmission unit (53, 63; 53', 63') being 1;

wherein said first input end gear (49, 49') of said first partial transmission unit (53, 53') has a diameter (d49, d49') larger than a diameter (d51, d51') of said first output end gear (51, 51'), and wherein said second input end gear (60, 60') of said second partial transmission unit (63, 63') has a diameter (d60, d60') smaller than a diameter (d62, d62') of said second output end gear (62, 62').

2. A sewing machine according to claim 1, wherein $0.5<i1<0.8$ applies for a transmitting ratio (i1) of said first partial transmission unit (53), which is defined as $i1=d51/d49$ by the quotient of the diameter (d51) of said first output end gear (51) and of the diameter (d49) of said first input end gear (49).

3. A sewing machine according to claim 1, wherein said second partial transmission unit is coupled with a thread feeder drive (93), wherein the needle bar drive (87) is provided on a first side (91) of the needle bar (31) and the thread feeder drive (93) is provided on a second side (94) of the needle bar (31), wherein said second side is opposite said first side, wherein the needle bar drive (87) has a shaft (82) drivable by said second partial transmission unit (63), wherein the thread feeder drive (93) has a shaft (98) drivable by said second partial transmission unit (63), and wherein these shafts (82, 98) are parallel to one another.

4. A sewing machine according to claim 3, wherein the axis (29) of the rotary housing (28) and an axis (57) of said first output end gear (49) of said first partial transmission unit (53) lie on a common plane (58), and wherein the shafts (82, 98) extend approximately perpendicular to said plane (58).

5. A sewing machine according to claim 3, wherein the shafts (82, 98) of said second partial transmission unit (63) are drivable by an auxiliary shaft (55) parallel to said shafts (82, 98) and each by a drive (64, 65, 66; 95, 96, 97) connecting the auxiliary shaft (55) with a shaft (82 or 98, respectively) and being located each on one of said first and said second sides (91, 94) of the rotary housing (28).

6. A sewing machine according to claim 5, wherein—in relation to the axis (29) of the rotary housing (28)—each of the shafts (82, 98) is arranged on one of two different sides of the auxiliary shaft (55).

* * * * *